US009236669B2

(12) United States Patent
Mann et al.

(10) Patent No.: US 9,236,669 B2
(45) **Date of Patent: *Jan. 12, 2016**

(54) ELECTRICALLY AND THERMALLY NON-METALLIC CONDUCTIVE NANOSTRUCTURE-BASED ADAPTERS

(75) Inventors: Jennifer Mann, Chichester, NH (US); David S. Lashmore, Lebanon, NH (US); Brian White, Manchester, NH (US)

(73) Assignee: Nanocomp Technologies, Inc., Merrimack, NH (US)

( * ) Notice: Subject to any disclaimer, the term of this patent is extended or adjusted under 35 U.S.C. 154(b) by 207 days.

This patent is subject to a terminal disclaimer.

(21) Appl. No.: 12/187,278

(22) Filed: Aug. 6, 2008

(65) Prior Publication Data

US 2009/0042455 A1 Feb. 12, 2009

Related U.S. Application Data

(60) Provisional application No. 60/963,860, filed on Aug. 7, 2007, provisional application No. 61/044,354, filed on Apr. 11, 2008.

(51) Int. Cl.

| | |
|---|---|
| ***H01B 7/00*** | (2006.01) |
| ***H01R 4/58*** | (2006.01) |
| ***H01B 1/24*** | (2006.01) |

(52) U.S. Cl.

CPC ... *H01R 4/58* (2013.01); *H01B 1/24* (2013.01)

(58) Field of Classification Search

USPC ..... 174/126.1; 219/544, 553

See application file for complete search history.

(56) References Cited

U.S. PATENT DOCUMENTS

| | | | |
|---|---|---|---|
| 3,090,876 | A | 5/1963 | Hutson |
| 3,109,712 | A | 11/1963 | Redfern |

(Continued)

FOREIGN PATENT DOCUMENTS

| | | |
|---|---|---|
| CN | 1614772 | 5/2005 |
| DE | 102006014171 | 9/2007 |

(Continued)

OTHER PUBLICATIONS

International Search Report based on PCT/US08/72379 dated Oct. 21, 2008.

(Continued)

*Primary Examiner* — Chau N Nguyen

(74) *Attorney, Agent, or Firm* — Greenberg Traurig, LLP; Chinh H. Pham; Todd C. Basile

(57) ABSTRACT

A conductive adapter for carrying relatively high current from a source to an external circuit without degradation is provided. The adapter includes a conducting member made from a conductive nanostructure-based material and having opposing ends. The adapter can also include a connector portion positioned on one end of the conducting member for maximizing a number of conductive nanostructures within the conducting member in contact with connector portion, so as to enable efficient conduction between a nanoscale environment and a traditional electrical and/or thermal circuit system. The adapter can further include a coupling mechanism situated between the conducting member and the connector portion, to provide a substantially uniform contact between the conductive nanostructure-based material in the conducting member and the connector portion. A method for making such a conductive adapter is also provided.

36 Claims, 4 Drawing Sheets

(56) References Cited

U.S. PATENT DOCUMENTS 3,462,289 A 8/1969 Rohl et al.
3,706,193 A 12/1972 Amato ..... 57/58.89
3,943,689 A 3/1976 Kunz et al. ..... 57/34
4,384,944 A 5/1983 Silver et al. ..... 204/159.13
4,468,922 A 9/1984 McCrady et al. ..... 57/402
4,572,813 A 2/1986 Arakawa ..... 264/29.2
4,583,247 A 4/1986 Fingerhut et al.
4,897,167 A * 1/1990 Cook et al. ..... 205/291
4,987,274 A 1/1991 Miller et al. ..... 174/102
5,168,004 A 12/1992 Daumit et al. ..... 428/221
5,405,590 A 4/1995 Macedo et al. ..... 423/210
5,428,884 A 7/1995 Tsuzuki ..... 29/290
5,488,752 A 2/1996 Randolph ..... 15/250.06
5,648,027 A 7/1997 Tajiri et al.
5,747,161 A 5/1998 Iijima
5,874,159 A 2/1999 Cruise et al.
6,036,774 A 3/2000 Lieber et al. ..... 117/105
6,043,468 A 3/2000 Toya et al.
6,110,590 A 8/2000 Zarkoob et al. ..... 428/364
6,143,412 A * 11/2000 Schueller et al. ..... 428/408
6,265,466 B1 7/2001 Glatkowski et al. ..... 523/137
6,308,509 B1 10/2001 Scardino et al. ..... 57/402
6,333,016 B1 12/2001 Resasco et al. ..... 423/447.3
6,376,971 B1 4/2002 Pelrine et al.
6,426,134 B1 7/2002 Lavin et al.
6,452,085 B2 9/2002 Tauchi et al.
6,495,116 B1 12/2002 Herman
6,541,744 B2 4/2003 Von Arx et al.
6,611,039 B2 8/2003 Anthony et al.
6,682,677 B2 1/2004 Lobovsky et al. ..... 264/172.11
6,703,104 B1 3/2004 Neal
6,706,402 B2 3/2004 Rueckes et al.
6,713,034 B2 3/2004 Nakamura et al.
6,784,656 B2 8/2004 Breinlinger
6,790,426 B1 9/2004 Ohsaki
6,842,328 B2 1/2005 Schott et al. ..... 361/302
6,908,572 B1 6/2005 Derbyshire et al.
6,923,946 B2 8/2005 Geohegan et al.
6,955,937 B1 * 10/2005 Burke et al. ..... 438/53
6,979,709 B2 12/2005 Smalley et al.
7,045,108 B2 5/2006 Jiang et al.
7,048,999 B2 5/2006 Smalley et al. ..... 428/367
7,052,668 B2 5/2006 Smalley et al.
7,182,929 B1 2/2007 Singhal et al.
7,226,531 B2 6/2007 Lo et al. ..... 205/109
7,323,157 B2 1/2008 Kinloch et al.
7,413,474 B2 8/2008 Liu et al.
7,437,938 B2 * 10/2008 Chakraborty ..... 73/714
7,491,883 B2 2/2009 Lee et al.
7,553,472 B2 6/2009 Mouli et al.
7,615,097 B2 11/2009 McKechnie et al.
7,615,204 B2 11/2009 Ajayan et al.
7,727,504 B2 6/2010 Kittrell et al.
7,745,810 B2 6/2010 Rueckes et al.
7,750,240 B2 7/2010 Jiang et al.
7,846,414 B2 12/2010 Harbec et al.
7,892,677 B2 2/2011 Shirane et al.
7,897,248 B2 3/2011 Barrera et al.
7,965,156 B2 * 6/2011 Ward et al. ..... 333/186
8,017,272 B2 9/2011 Feng et al.
8,071,906 B2 12/2011 Smiljanic et al.
8,119,095 B2 2/2012 Ahn et al.
2001/0003576 A1 6/2001 Klett et al. ..... 423/445
2002/0004028 A1 1/2002 Margrave et al. ..... 423/447.3
2002/0040900 A1 * 4/2002 Arx et al. ..... 219/544
2002/0113335 A1 8/2002 Lobovsky et al. ..... 264/184
2002/0130610 A1 9/2002 Gimzewski et al.
2002/0136681 A1 9/2002 Smalley et al. ..... 423/447.2
2002/0159943 A1 10/2002 Smalley et al. ..... 423/447.1
2002/0179564 A1 12/2002 Geobegan et al.
2003/0012111 A1 1/2003 Lee
2003/0036877 A1 2/2003 Schietinger ..... 702/134
2003/0104156 A1 6/2003 Osada et al.
2003/0109619 A1 6/2003 Keller et al. ..... 524/440
2003/0133865 A1 7/2003 Smalley et al.
2003/0134916 A1 7/2003 Hrubesh
2003/0143453 A1 7/2003 Ren et al.
2003/0165648 A1 9/2003 Lobovsky et al. ..... 428/36.9
2003/0222015 A1 12/2003 Oyama et al. ..... 210/500.21
2004/0020681 A1 2/2004 Hjortstam et al.
2004/0041154 A1 3/2004 Watanabe et al.
2004/0053780 A1 3/2004 Jiang et al. ..... 502/182
2004/0081758 A1 4/2004 Mauthner et al.
2004/0096389 A1 5/2004 Lobovsky et al. ..... 423/447.1
2004/0124772 A1 7/2004 Chen
2004/0150312 A1 8/2004 McElrath et al.
2004/0173906 A1 9/2004 Saito et al.
2004/0177451 A1 9/2004 Poulin et al.
2004/0197638 A1 * 10/2004 McElrath et al. ..... 429/44
2004/0240144 A1 12/2004 Schott et al.
2004/0265212 A1 12/2004 Varadan et al.
2004/0265489 A1 12/2004 Dubin
2004/0266065 A1 12/2004 Zhang et al.
2005/0000559 A1 1/2005 Horio et al.
2005/0006801 A1 1/2005 Kinloch et al. ..... 264/5
2005/0046017 A1 3/2005 Dangelo ..... 257/720
2005/0063658 A1 3/2005 Crowley
2005/0067406 A1 * 3/2005 Rajarajan et al. ..... 219/553
2005/0074569 A1 4/2005 Lobovsky et al. ..... 428/36.9
2005/0087222 A1 4/2005 Muller-Werth
2005/0087726 A1 4/2005 Anazawa et al.
2005/0095938 A1 5/2005 Rosenberger et al.
2005/0104258 A1 5/2005 Lennhoff ..... 264/465
2005/0112051 A1 5/2005 Liu et al.
2005/0170089 A1 8/2005 Lashmore et al. ..... 427/248.1
2005/0179594 A1 8/2005 Morikawa et al.
2005/0269726 A1 12/2005 Matabayas, Jr.
2006/0118158 A1 6/2006 Zhang et al.
2006/0185985 A1 8/2006 Jones ..... 205/508
2006/0207643 A1 9/2006 Weaver, Jr. et al.
2006/0252853 A1 11/2006 Ajayan et al.
2006/0269670 A1 11/2006 Lashmore et al. ..... 427/249.1
2006/0272701 A1 12/2006 Ajayan et al.
2007/0009421 A1 1/2007 Kittrell et al.
2007/0029291 A1 2/2007 Boulos et al.
2007/0048211 A1 3/2007 Jiang et al.
2007/0056855 A1 3/2007 Lo et al.
2007/0087121 A1 4/2007 Chang et al.
2007/0104993 A1 5/2007 Lee et al.
2007/0116627 A1 5/2007 Collier et al.
2007/0140947 A1 6/2007 Schneider et al.
2007/0151744 A1 7/2007 Chen ..... 174/110
2007/0232699 A1 10/2007 Russell et al.
2007/0236325 A1 10/2007 Bertin et al.
2007/0277866 A1 12/2007 Sander et al.
2007/0293086 A1 12/2007 Liu et al.
2008/0001284 A1 1/2008 Yuen et al.
2008/0031801 A1 2/2008 Lackner et al. ..... 423/438
2008/0166563 A1 7/2008 Brittingham et al.
2008/0170982 A1 7/2008 Zhang et al.
2008/0192014 A1 * 8/2008 Kent et al. ..... 345/173
2008/0238882 A1 10/2008 Sivarajan et al.
2009/0044848 A1 2/2009 Lashmore et al.
2009/0047513 A1 2/2009 Lashmore
2009/0075545 A1 3/2009 Lashmore et al.
2009/0117025 A1 5/2009 Lashmore et al.
2009/0127712 A1 5/2009 Wyland
2009/0169819 A1 7/2009 Drzaic et al.
2009/0194525 A1 * 8/2009 Lee et al. ..... 219/553
2009/0196981 A1 8/2009 Liu et al.
2009/0255706 A1 10/2009 Jiang et al.
2009/0266477 A1 10/2009 Weisenberger
2009/0269511 A1 10/2009 Zhamu et al.
2009/0277897 A1 * 11/2009 Lashmore et al. ..... 219/544
2009/0305135 A1 12/2009 Shi et al.
2009/0317710 A1 12/2009 Douglas et al.
2010/0000754 A1 1/2010 Mann et al.
2010/0021682 A1 1/2010 Liang et al.
2010/0041297 A1 2/2010 Jiang et al.
2010/0044074 A1 2/2010 Kim et al.
2010/0219383 A1 9/2010 Eklund
2010/0220074 A1 9/2010 Irvin, Jr. et al.
2010/0243227 A1 9/2010 Wu et al.
2010/0243295 A1 9/2010 Allemand et al.

(56) References Cited

U.S. PATENT DOCUMENTS

| | | | | |
|---|---|---|---|---|
| 2010/0252184 | A1 | 10/2010 | Morimoto et al. | |
| 2010/0252802 | A1* | 10/2010 | Numata et al. | 257/9 |
| 2010/0261821 | A1 | 10/2010 | Park et al. | |
| 2010/0267205 | A1 | 10/2010 | Ward et al. | |
| 2010/0270058 | A1 | 10/2010 | Mahoney et al. | |
| 2010/0271253 | A1 | 10/2010 | Shah et al. | |
| 2010/0324656 | A1 | 12/2010 | Lashmore et al. | |
| 2010/0328845 | A1 | 12/2010 | Hiralal et al. | |
| 2011/0005808 | A1 | 1/2011 | White et al. | |
| 2011/0007477 | A1 | 1/2011 | Xu et al. | |
| 2011/0027491 | A1 | 2/2011 | Rueckes et al. | |
| 2012/0015098 | A1 | 1/2012 | Cheng et al. | |
| 2012/0045385 | A1 | 2/2012 | Lashmore et al. | |
| 2012/0118552 | A1 | 5/2012 | White et al. | |

FOREIGN PATENT DOCUMENTS

| | | | |
|---|---|---|---|
| EP | 1160861 A2 | 12/2001 | |
| JP | 1958-072036 | 5/1983 | |
| JP | H09-509779 | 9/1997 | |
| JP | 2000-058228 | 2/2000 | |
| JP | 2003-518330 | 6/2003 | |
| JP | 2003-298338 | 10/2003 | |
| JP | 2004-315297 | 11/2004 | |
| JP | 2005-502792 | 1/2005 | |
| JP | 2005-075672 | 3/2005 | |
| JP | 2005-109870 | 4/2005 | |
| JP | 2005-116839 | 4/2005 | |
| JP | 2005/281672 | 10/2005 | |
| JP | 2006-335604 | 12/2006 | |
| JP | 2007-009213 | 1/2007 | |
| JP | 2007015059 | 1/2007 | |
| JP | 2007-182352 | 7/2007 | |
| JP | 2002-515847 | 5/2008 | |
| JP | 2008-519454 | 6/2008 | |
| JP | 2008-523254 | 7/2008 | |
| JP | 2008-260648 | 10/2008 | |
| JP | 2008-297196 | 12/2008 | |
| JP | 2009-242145 | 10/2009 | |
| JP | 2009-252713 | 10/2009 | |
| JP | 2011-508364 | 3/2011 | |
| KR | 2005-0007886 | 1/2005 | |
| WO | 95/18517 | 7/1995 | |
| WO | WO 98/39250 | 9/1998 | |
| WO | 01/46967 | 6/2001 | |
| WO | 2005/069412 | 7/2005 | |
| WO | WO 2005/098084 | 10/2005 | |
| WO | 2006/048845 | 5/2006 | |
| WO | WO 2006/069007 | 6/2006 | |
| WO | WO 2006/073460 | 7/2006 | |
| WO | WO 2006/099156 | 9/2006 | |
| WO | WO 2007/003879 | 1/2007 | |
| WO | WO 2007/015710 | 2/2007 | B29C 47/04 |
| WO | 2007/089118 | 8/2007 | |
| WO | WO 2007/086909 | 8/2007 | |
| WO | WO 2007/089118 | 8/2007 | |
| WO | 2008/002071 | 1/2008 | |
| WO | WO 2008/036068 | 3/2008 | |
| WO | WO 2008/048286 | 4/2008 | |
| WO | 2009/072478 | 6/2009 | |
| WO | 2009/155267 | 12/2009 | |
| WO | 2010/036405 | 4/2010 | |
| WO | 2010/151244 | 12/2010 | |
| WO | WO 2011/005964 | 1/2011 | |

OTHER PUBLICATIONS

International Search Report based on PCT/US08/73488 dated Nov. 14, 2008.

R.T.K. Baker et al., "*Nucleation and Growth of Carbon Deposits from the Nickel Catalyzed Decomposition of Acetylene*", Journal of Catalysis, 26:51-62 (1972).

H.W. Kroto et al., "*C60: Buckminsterfullerene*", Letters to Nature, 318:162-163, (1985).

Sumio Iijima, "*Helical microtubules of graphitic carbon*", Letters to Nature, 354:56-58, (1991).

D.S. Bethune et al., Cobalt-catalyzed growth of carbon nanotubes with single-atomic-layer walls, *Letters to Nature*, 363:605-607 (1993).

M. Jose-Yacaman et al., "*Catalytic growth of carbon microtubules with fullerene structure*", Applied Physics Letters, 62(6):657-659 (1993).

Gun-Do Lee et al, "*Catalytic decomposition of acetylene on Fe*(001): *A first-principles study*", The American Physical Society, Physical Review B66 081403R:1-4 (2002).

N. Seo Kim et al., "*Dependence of the Vertically Aligned Growth of Carbon Nanotubes on the Catalysts*", The Journal of Physical Chemistry, 106(36):9286-9290 (2002).

H. W. Zhu et al., "*Direct Synthesis of Long Single-Walled Carbon Nanotube Strands*", Science, 296:884-886 (2002).

Ki-Hong Lee et al., "*Control of growth orientation for carbon* nanotubes", Applied Physics Letters, 82(3): 448-450, (2003).

E. F. Kukovitsky et al., "*CVD growth of carbon nanotube films on nickel substrates*", Applied Surface Science, 215:201-208 (2003).

Gou, J.G., "*Single-Walled Carbon Nanotube Bucky Paper/Epoxy Composites: Molecular Dynamics Simulation and Process Development*", PhD dissertation, The Florida State University, 2002, p. 9-126.

Li, et al. "*Direct Spinning of Carbon Nanotube Fibers from Chemical Vapor Deposition Synthesis*", Science Magazine, 2004, vol. 304, pp. 276-278.

Okabe, T. et al., *New Porous Carbon Materials, Woodceramics: Development and Fundamental Properties*, Journal of Porous Materials, vol. 2, pp. 207-213, 1996.

Seung-Yup Lee et al., *Synthesis of Carbon Nanotubes Over Gold Nanoparticle Supported Catalysts*, Carbon, 43 (2005), pp. 2654-2663.

Gou, J.G., "*Passage: Nanotube Bucky Papers and Nanocomposites*", Ph.D. Dissertation, Marburg An Der Lahn, pp. 93-126, Jan. 1, 2002.

Hanson, G.W., "Fundamental Transmitting Properties of Carbon Nanotube Antennas", IEEE Transactions on Antennas and Propagation, vol. 53, No. 11, pp. 3426-3435, Nov. 2005.

Merriam Webster Dictionary definition of "along", available at http://merriam-webster.com/dictionary/along (retrieved Sep. 16, 2010).

"Metallurgical & Chemical Engineering", McGraw Publishing Co., vol. 15, No. 5, pp. 258-259, Dec. 15, 1916.

Schaevitz et al., "*A Combustion-Based Mems Thermoelectric Power Generator*", The 11th Conference on Solid-State Sensors and Actuators, Munich, Germany, Jun. 10-14, 2001.

Xiao et al., "*High-Mobility Thin-Film Transistors Based on Aligned Carbon Nanotubes*", Applied Physics Letters, vol. 83, No. 1, pp. 150-152, Jul. 7, 2003.

Office Action cited in U.S. Appl. No. 11/413,512 mailed Jul. 8, 2010.

Office Action cited in U.S. Appl. No. 11/415,927 mailed Feb. 22, 2010.

Office Action cited in U.S. Appl. No. 11/415,927 mailed Sep. 9, 2010.

Office Action cited in U.S. Appl. No. 11/715,756 mailed Jan. 25, 2010.

Office Action cited in U.S. Appl. No. 11/818,279 mailed Jun. 2, 2010.

Office Action cited in U.S. Appl. No. 12/191,765 mailed May 14, 2010.

Office Action cited in U.S. Appl. No. 12/390,906 mailed Jul. 9, 2010.

International Search Report based on PCT/US2009/043209 dated Mar. 3, 2010.

International Search Report based on PCT/US2010/041374 dated Sep. 8, 2010.

European Search Report based on EP 06849762.7 dated Jan. 14, 2010.

Australian Examiner's Report cited in AU Serial No. 2006249601 dated Jun. 24, 2010.

Australian Examiner's Report cited in AU Serial No. 2006350110 dated Feb. 9, 2010.

Supplementary European Search Report based on EP 08797307 dated Mar. 29, 2011.

Supplementary European Search Report based on EP 06851749 dated Apr. 1, 2011.

Pipes et al., "Helical carbon nanotube arrays: mechanical properties," Composites Science and Technology. 62: 419-428 (2002).

(56) References Cited

OTHER PUBLICATIONS

Canadian Search Report for Canadian Patent Application No. 2,609,712 mailed Jul. 30, 2012.
European Search Report for European Patent Application No. 10160098.9 mailed Mar. 9, 2012.
European Search Report for European Patent Application No. 12160856.6 mailed May 10, 2012.
European Search Report for European Patent Application No. 08726128.5 mailed Aug. 10, 2012.
International Search Report for International Patent Application No. PCT/US12/20194 mailed May 1, 2012.
International Search Report for International Patent Application No. PCT/US12/33300 mailed Jul. 5, 2012.
Japanese Office Action issued for Japanese Patent Application No. 2009-551705 mailed on May 29, 2012.
Office Action issued for Australian Patent Application No. 2008311234 mailed on Feb. 14, 2012.
Office Action issued for U.S. Appl. No. 12/038,408 mailed on Feb. 23, 2012.
Office Action issued for U.S. Appl. No. 12/580,994 mailed on Mar. 12, 2012.
Office Action issued for U.S. Appl. No. 12/437,538 mailed on Mar. 26, 2012.
Office Action issued for U.S. Appl. No. 12/566,229 mailed on May 4, 2012.
Office Action issued for U.S. Appl. No. 12/437,535 mailed on Aug. 22, 2012.
Biro, et al., "Direct Synthesis of Multi-Walled and Single-Walled Carbon Nanotubes by Spray-Pyrolysis", J. Optoelectronics and Advanced Materials, Sep. 2003; vol. 5, No. 3, pp. 661-666.
Jiang, et al., "Spinning Continuous Carbon Nanotube Yarns", Nature, Oct. 24, 2002, vol. 419, p. 801.
Moisala et al., "Single-walled carbon nanotube synthesis using ferrocene and iron pentacarbonyl in a laminar flow reactor," *Chemical Engineering Science*, 61(13), pp. 4393-4402 (Jul. 2006).
Tapaszto, et al., "Diameter and Morphology Dependence on Experimental Conditions of Carbon Nanotube Arrays Grown by Spray Pyrolysis", Carbon, Jan. 2005; vol. 43, pp. 970-977.
Non-Final Office Action in U.S. Appl. No. 12/140,263 mailed Sep. 20, 2010.
Non-Final Office Action in U.S. Appl. No. 12/038,408 mailed Oct. 14, 2010.
Non-Final Office Action in U.S. Appl. No. 12/437,537 mailed Oct. 25, 2010.
Final Office Action in U.S. Appl. No. 12/191,765 mailed Oct. 28, 2010.
Supplementary European Search Report based on EP 06851553.5 dated Nov. 15, 2010.
Official Action cited in JP Serial No. 2008-540155 dated Mar. 8, 2011.
Final Office Action in U.S. Appl. No. 12/140,263 mailed Mar. 9, 2011.
Non-Final Office Action in U.S. Appl. No. 11/415,927 mailed Mar. 10, 2011.
Non-Final Office Action in U.S. Appl. No. 12/180,300 mailed Mar. 16, 2011.
Non-Final Office Action in U.S. Appl. No. 12/191,765 mailed Apr. 4, 2011.
Non-Final Office Action in U.S. Appl. No. 12/566,229 mailed Apr. 6, 2011.
Non-Final Office Action in U.S. Appl. No. 12/437,537 mailed Apr. 7, 2011.
Final Office Action in U.S. Appl. No. 12/038,408 mailed Apr. 13, 2011.
Official Action cited in JP Serial No. 2008-540155 dated Nov. 4, 2011.
Seo et al., "Synthesis and manipulation of carbon nanotubes," New Journal of Physics. 5: 120.1-120.22 (2003).
International Search Report for International Patent Application No. PCT/US12/48665 mailed Nov. 20, 2012.
Office Action issued for U.S. Appl. No. 12/437,535 mailed on Dec. 5, 2012.
Office Action issued for U.S. Appl. No. 12/841,768 mailed on Mar. 13, 2013.
Office Action issued for U.S. Appl. No. 13/191,109 mailed on Mar. 28, 2013.
Office Action issued for Japanese Patent Application No. 2011-508689 mailed on Mar. 19, 2013.
Ci et al., "Carbon nanofibers and single-walled nanotubes prepared by the floating catalyst method" Carbon. 39:329-335 (2001).
Ng, "Signal walled CNT paper as anode for lithium-ion battery," Elechtrochimica. 51: 23-28 (2005).
Wang et al., "Processing and property investigation of single-walled carbon nanotube (SWNT) buckypaper/epoxy resin matrix nanocomposites," Composites: Part A. 35: 1225-1232 (2004).
European Search Report issued in European Application No. 09743711.5 mailed on Oct. 21, 2013.
International Search Report issued in International Application No. PCT/US13/35844 mailed on Jul. 12, 2013.
International Search Report issued in International Application No. PCT/US13/22873 mailed on Sep. 27, 2013.
Japanese Office Action issued in Japanese Application No. 2011-508689 mailed on Nov. 19, 2013.
Japanese Office Action issued in Japanese Application No. 2011-508688 mailed on Nov. 19, 2013.
Japanese Office Action issued in Japanese Application No. 2012-519729 mailed on Nov. 26, 2013.
Office Action issued in U.S. Appl. No. 12/390,906 mailed on Sep. 30, 2013.
Office Action issued in U.S. Appl. No. 12/140,263 mailed on Oct. 1, 2013.
Office Action issued in U.S. Appl. No. 12/437,538 mailed on Nov. 26, 2013.
Office Action issued in U.S. Appl. No. 12/437,535 mailed on Sep. 8, 2014.
Japanese Office Action issued in Japanese Application No. 2011-508688 mailed on Jul. 1, 2014.
Office Action issued in U.S. Appl. No. 13/367,572 mailed on Aug. 26, 2014.
Office Action issued in U.S. Appl. No. 13/445,576 mailed on Sep. 9, 2014.

* cited by examiner

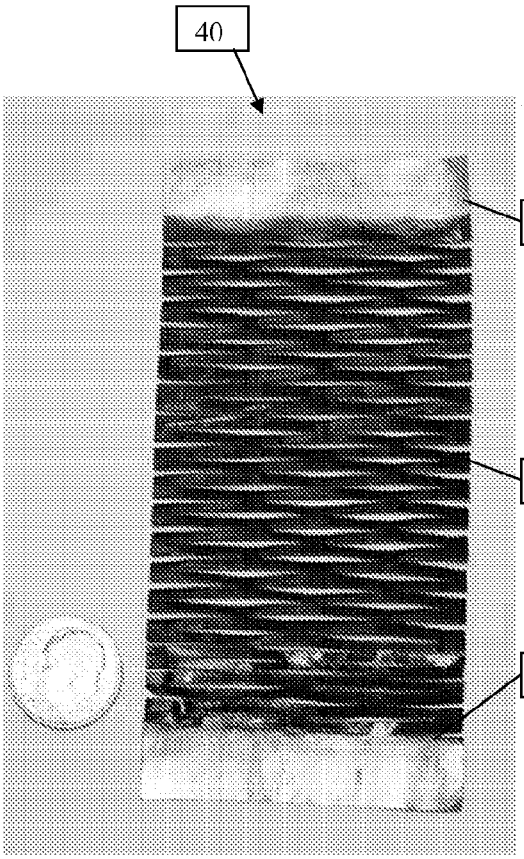
Fig. 4A
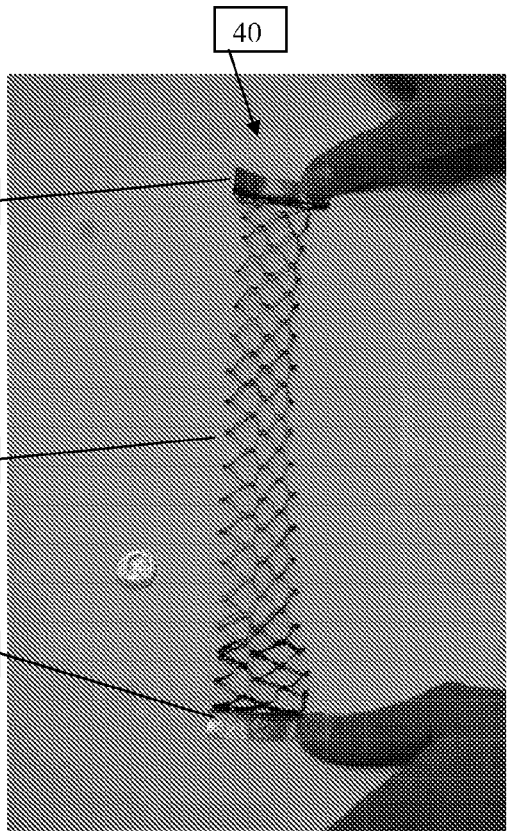
Fig. 4B
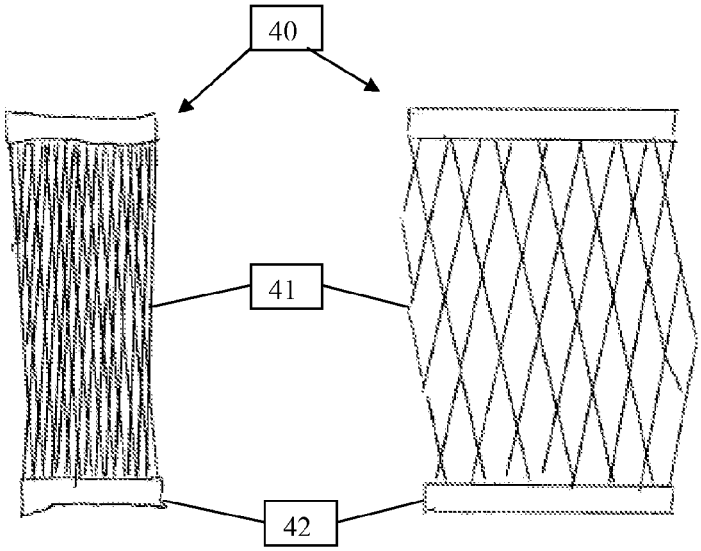
Fig. 4C
Fig. 4D

ELECTRICALLY AND THERMALLY NON-METALLIC CONDUCTIVE NANOSTRUCTURE-BASED ADAPTERS

RELATED U.S. APPLICATION(S)

The present invention claims priority to U.S. Provisional Application Ser. Nos. 60/963,860, filed Aug. 7, 2007, and 61/044,354, filed Apr. 11, 2008, both of which are hereby incorporated herein by reference.

TECHNICAL FIELD

The present invention relates to electrical and thermal adapters, and more particularly, to nanostructure-based adapters designed to maximize interaction between a nanoscale conductive element and a traditional electrical and/or thermal circuit system.

BACKGROUND ART

The joining of electrical conductors to another element, such as a connector, in a system usually involves the use of an adhesive, and/or the use of mechanical means, such as crimping or a solder connection. All of these have some disadvantages.

Adhesives

Electrical or thermal contact between elements can sometimes be provided by means of an adhesive. For example, a joint between a high surface area element in an electrolytic capacitor may be formed by means of a complex cellulose binder and an aluminum or titanium foil. This type of binding system can generate a substantially high internal resistance that can severely degrade the performance of the capacitor. This internal resistance can also serve to increase the capacitor time constant ($\tau$=R*C). Other binding examples can include epoxy bonding of the components involved. Such bonding may have dual functions, including (1) providing a mechanical bond, and (2) carrying heat, as seen with bonding of elements of an airplane or jet engine close to a heat source.

In the case of thermal junctions, the provision of good contact area can often be difficult. For example, it can be difficult to provide a good contact at the junction between an integrated circuit housing and a heat sink, where a thermal resistance of more than 20 degrees may be needed to drive, for instance, 150 watts per square cm though the junction.

Mechanical Means

It has been shown by the Kuhlmann-Wilsdorf theory of electrical contacts, and by analogy through the R. Holm theory for electrical contacts, that electrical current or thermal energy must necessarily pass though two contacting surfaces in only a few, or perhaps up to 50 atomic contact spots. Interestingly, this is not strongly dependent on the total area of contact, but rather can be dependent upon clamping force between contacts. This limitation of the total surface area that may be in actual contact between a connector and its corresponding contacting element can generally introduce a severe electrical or thermal contact resistance.

Solder Connections

To overcome this contact resistance and improve overall conductivity, the effective contact area may need to be increased. One means of accomplishing this is by soldering. However, the lead-tin alloys in common use for soldering, or even lead free solders (e.g., silver-antimony-tin), can have a strong tendency to form intermetallic compounds or layers at the solder joint or junction. Formation of intermetallic compounds usually occurs because, for instance, the tin-copper etc., present in the solder can exhibit fast diffusion when coupled with common conductors, such as copper, generally used for both thermal and electrical conduction. Moreover, the formation of intermetallic compounds or layers can continue to occur, over time, even at ambient temperatures. The consequence of such a formation at these junctions is that the intermetallic layer itself can become brittle (i.e., degradable), as well as electrically and thermally resistive, leading to an increasing resistance or even a catastrophic mechanical failure at solder junctions, especially when these junctions have a different coefficient of thermal expansion.

This holds true for both thermal and electrical junctions. Examples of solder system degradation due to intermetallic formations have been widely reported in the automotive industry, aerospace industry, and even in military missiles.

A common approach for addressing this problem has been the introduction of a "silver powder containing grease" between a heat generating element and a heat dissipating element. This grease can increase thermal transport, as it provides an additional thermal path, even though the grease may be of high thermal resistance itself. Fillers, such as silver powders, can often be added to this grease, and can also help in improving heat.

In addition to the above issues, there does not currently exist a design for joining and maximizing the number of conductive nanostructures involved in conductivity to the devices in the macro-world, while enhancing or maintaining the efficiency of the electrical or thermal transport exhibit by these conductive nanostructures.

In light of these issues, it would be desirable to provide a way to allow for efficient interaction between a nanoscale conductive element and the traditional electrical and/or thermal circuit system, while minimizing electrical or thermal resistance and improve overall conductivity.

SUMMARY OF THE INVENTION

The present invention provides, in accordance with one embodiment, a conductive adapter. The adapter includes, in an embodiment, a conducting member made from a conductive nanostructure-based material and having opposing ends. Such a material may be wires, yarns, tapes, ribbons or sheets made from carbon nanotubes. In an embodiment, the conducting member can be made from one of carbon, copper, silver, boron, boron-nitride, $MoS_2$ or similar compounds, or a combination thereof. The adapter can also include a connector portion positioned on one end of the conducting member for maximizing a number of conductive nanostructures within the conducting member in contact with connector portion, so as to enable efficient conduction between a nanoscale environment and a traditional electrical and/or thermal circuit system. In one embodiment, the connector portion may be made from one of copper, aluminum, gold, silver, silver coated copper, cadmium, nickel, tin, bismuth, arsenic, alloys of these metals, boron, boron nitride, glassy carbon, ceramics, silicon, silicon compounds, gallium arsenic, a combination thereof, or other materials capable of being electrically and/or thermally conductive. The adapter may further include a coupling mechanism situated between the conducting member and the connector portion, to provide a substantially uniform contact between the conductive nanostructure-based material in the conducting member and the connector portion. In one embodiment, the coupling mechanism may be a glassy carbon material capable of providing substantially low resistance coupling. The coupling mechanism may also provide the conducting member with substantially uniform contact to the connector portion across a contact surface area on the connector portion.

In an alternate embodiment, the connector portion may be deposited, such as by electroplating, on at least on of the opposing ends of the conducting member. In this embodiment, connector portion can be made from one of gold, silver, nickel, aluminum, copper, bismuth, tin, zinc, cadmium, tin-nickel alloy, copper alloy, tin-zinc alloy, bismuth-copper alloy, cadmium-nickel alloy, other conductive metals and their alloys, or a combination thereof. Moreover, the conducting member can be imparted with a design to permit extension of the conducting member in at least one direction.

In another embodiment of the present invention, there is provided a method for making a conductive adapter. The method includes initially providing a conducting member made from a nanostructure-based material and a connector portion to which the conducting member may be joined. The conducting member, in one embodiment, can be wires, yarns, tapes, ribbons or sheets made from nanotubes. The nanotubes can be made from one of carbon, copper, silver, boron, boron-nitride, $MoS_2$ or similar compounds, or a combination thereof. In one embodiment, the connector portion may be made from one of copper, aluminum, gold, silver, silver coated copper, boron, boron nitride, glassy carbon, ceramics, silicon, silicon compounds, gallium arsenic, a combination thereof, or other materials capable of being electrically and/or thermally conductive. Next, a coupling mechanism may be placed at a junction between the conducting member and the connector portion. In an embodiment, the coupling mechanism may be a glassy carbon precursor, such as furfuryl alcohol, Resol resin, or any material known to form glassy carbon when heat treated that can be deposited into the junction. The conducting member and connector portion may thereafter be held against one another, while the junction is heated to pyrolyze the glassy carbon precursor to form a glassy carbon low resistance coupling mechanism. In one embodiment, the minimum temperature of pyrolysis should be at least in the neighborhood of about 400° C. or higher. It should be appreciated that material that may be sensitive to this temperature may not be suitable for this invention. Moreover, pyrolysis need not go to completion for this junction to offer substantially superior contact resistance to the traditional means for coupling conducting members.

In a further embodiment of the invention, there is provided another method for making an conductive adapter. The method includes initially providing a conducting member made from a nanostructure-based material and having opposing ends. The conducting member, in one embodiment, can be wires, yarns, tapes, ribbons or sheets made from nanotubes. The nanotubes can be made from one of carbon, copper, silver, boron, boron-nitride, $MoS_2$ or similar compounds, or a combination thereof. Next, a connector portion may be deposited on at least one end of the conducting member for maximizing a number of conductive nanostructures within the conducting member in contact with connector portion, so as to enable efficient conduction between a nanoscale environment and a traditional electrical and/or thermal circuit system. In an embodiment, deposition can be accomplished by electroplating the connector portion on each of the opposing ends of the conducting member. In such an embodiment, one of gold, silver, nickel, aluminum, copper, bismuth, tin, zinc, cadmium, tin-nickel alloy, copper alloy, tin-zinc alloy, bismuth-copper alloy, cadmium-nickel alloy, other conductive metals and their alloys, or a combination thereof may be used to deposit the connector portion on each of the opposing ends of the conducting member. The method further including providing a patterned conducting member to permit extension of the conducting member in at least one direction. In particular, the design on the conducting member may be such that it permits extension of the conducting member along one of an X axis, Y axis, or a combination thereof.

BRIEF DESCRIPTION OF DRAWINGS

FIGS. 4A-E illustrate an extendible electrically and thermally conductive adapter in accordance with various embodiments of the present invention.

DESCRIPTION OF SPECIFIC EMBODIMENTS

Figure 1A:
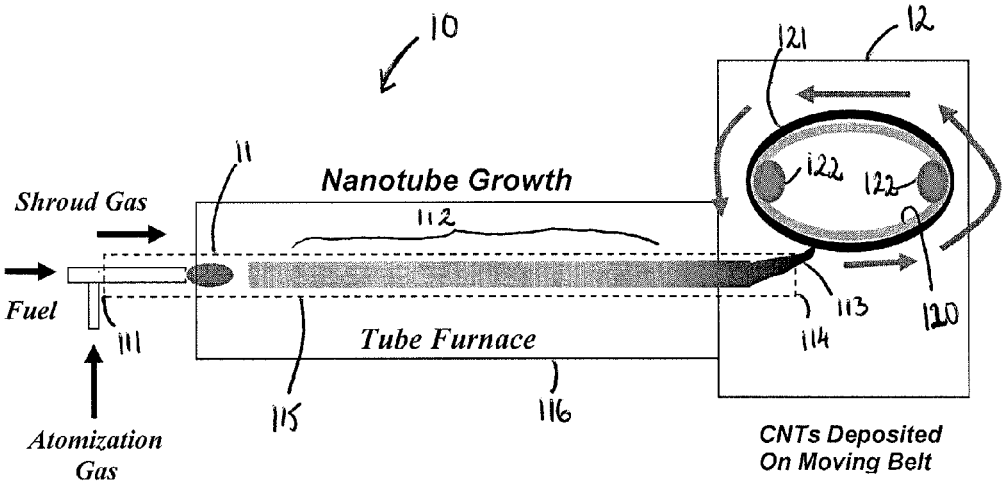
FIGS. 1A-B illustrate a Chemical Vapor Deposition system for fabricating nanotubes, in accordance with one embodiment of the present invention.
Figure 1B:
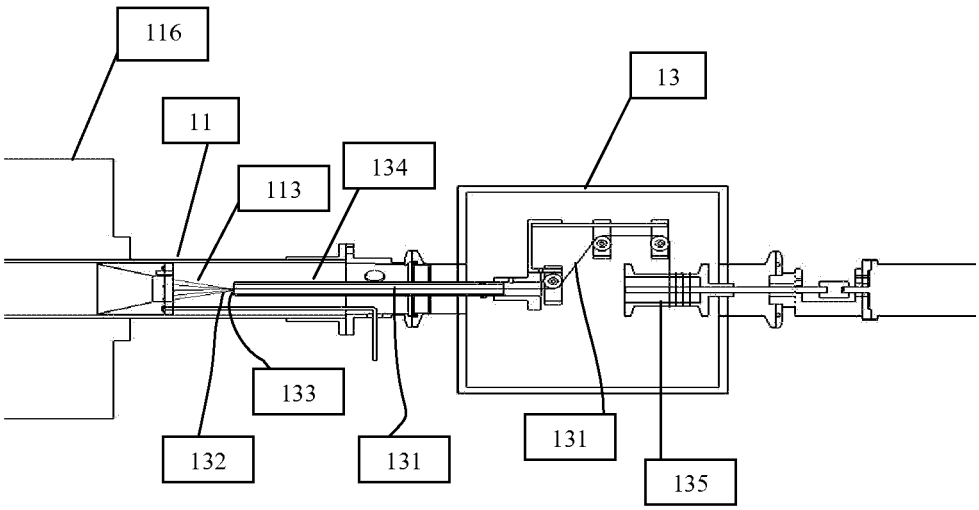

The need to carry relatively high current pulses between two movable conductors, such as a high energy capacitor, a ground strap, a bus bar or bus pipe, or pulse generating circuit, to an external circuit without degradation of the waveform or without heating of a junction requires careful engineering of the conduction path. This can be important where the conductor may be subject to movement which might cause fatigue damage in more commonly used copper conductors. To satisfy this need, the present invention provides, in an embodiment, a an approach for carrying relatively high current pulses through the use of a nanostructure-based conducting member, such as that made from carbon nanotubes in the form of, for example, a ribbon, a spun cable, or a sheet.

Presently, there exist multiple processes and variations thereof for growing nanotubes, and forming sheets or cable structures made from these nanotubes. These include: (1) Chemical Vapor Deposition (CVD), a common process that can occur at near ambient or at high pressures, and at temperatures above about 400° C., (2) Arc Discharge, a high temperature process that can give rise to tubes having a high degree of perfection, and (3) Laser ablation.

The present invention, in one embodiment, employs a CVD process or similar gas phase pyrolysis procedures known in the industry to generate the appropriate nanostructures, including carbon nanotubes. Growth temperatures for a CVD process can be comparatively low ranging, for instance, from about 400° C. to about 1350° C. Carbon nanotubes, both single wall (SWNT) or multiwall (MWNT), may be grown, in an embodiment of the present invention, by exposing nanoscaled catalyst particles in the presence of reagent carbon-containing gases (i.e., gaseous carbon source). In particular, the nanoscaled catalyst particles may be introduced into the reagent carbon-containing gases, either by addition of existing particles or by in situ synthesis of the particles from a metal-organic precursor, or even non-metallic catalysts. Although both SWNT and MWNT may be grown, in certain instances, SWNT may be selected due to their relatively higher growth rate and tendency to form rope-like structures, which may offer advantages in handling, thermal conductivity, electronic properties, and strength.

The strength of the individual carbon nanotubes generated in connection with the present invention may be about 30 GPa or more. Strength, as should be noted, is sensitive to defects. However, the elastic modulus of the carbon nanotubes fabricated in the present invention may not be sensitive to defects and can vary from about 1 to about 1.2 TPa. Moreover, the strain to failure of these nanotubes, which generally can be a structure sensitive parameter, may range from a about 10% to a maximum of about 25% in the present invention.

Furthermore, the nanotubes of the present invention can be provided with relatively small diameter. In an embodiment of the present invention, the nanotubes fabricated in the present invention can be provided with a diameter in a range of from less than 1 nm to about 10 nm.

The nanotubes of the present invention can also be used as a conducting member to carry relatively high current similar to a Litz wire or cable. However, unlike a Litz wire or cable soldered to a connector portion, the nanotube conducting member of the present invention can exhibit relatively lower impedance in comparison. In particular, it has been observed in the present invention that the shorter the current pulses, the better the nanotube-based wire cable or ribbon would perform when compared with a copper ribbon or Litz wire. One reason for the observed better performance may be that the effective frequency content of the pulse, which can be calculated from the Fourier Transform of the waveform for current pulses that are square and short, e.g., about 100 ms to less than about 1 ms, can be very high. Specifically, individual carbon nanotubes of the present invention can serve as conducting pathways, and due to their small size, when bulk structures are made from these nanotubes, the bulk structures can contain extraordinarily large number of conducting elements, for instance, on the order of $10^{14}/cm^2$ or greater.

Carbon nanotubes of the present invention can also demonstrate ballistic conduction as a fundamental means of conductivity. Thus, materials made from nanotubes of the present invention can represent a significant advance over copper and other metallic conducting members under AC current conditions. However, joining this type of conducting member to an external circuit requires that essentially each nanotube be electrically or thermally contacted to avoid contact resistance at the junction.

It should be noted that although reference is made throughout the application to nanotubes synthesized from carbon, other compound(s), such as boron, $MoS_2$, or a combination thereof may be used in the synthesis of nanotubes in connection with the present invention. For instance, it should be understood that boron nanotubes may also be grown, but with different chemical precursors. In addition, it should be noted that boron may also be used to reduce resistivity in individual carbon nanotubes. Furthermore, other methods, such as plasma CVD or the like can also be used to fabricate the nanotubes of the present invention.

System for Fabricating Nanotubes

With reference now to FIG. 1A, there is illustrated a system 10, similar to that disclosed in U.S. patent application Ser. No. 11/488,387 (incorporated herein by reference), for use in the fabrication of nanotubes. System 10, in an embodiment, may be coupled to a synthesis chamber 11. The synthesis chamber 11, in general, includes an entrance end 111, into which reaction gases (i.e., gaseous carbon source) may be supplied, a hot zone 112, where synthesis of extended length nanotubes 113 may occur, and an exit end 114 from which the products of the reaction, namely the nanotubes and exhaust gases, may exit and be collected. The synthesis chamber 11, in an embodiment, may include a quartz tube 115 extending through a furnace 116. The nanotubes generated by system 10, on the other hand, may be individual single-walled nanotubes, bundles of such nanotubes, and/or intertwined single-walled nanotubes (e.g., ropes of nanotubes).

System 10, in one embodiment of the present invention, may also include a housing 12 designed to be substantially airtight, so as to minimize the release of potentially hazardous airborne particulates from within the synthesis chamber 11 into the environment. The housing 12 may also act to prevent oxygen from entering into the system 10 and reaching the synthesis chamber 11. In particular, the presence of oxygen within the synthesis chamber 11 can affect the integrity and compromise the production of the nanotubes 113.

System 10 may also include a moving belt 120, positioned within housing 12, designed for collecting synthesized nanotubes 113 made from a CVD process within synthesis chamber 11 of system 10. In particular, belt 120 may be used to permit nanotubes collected thereon to subsequently form a substantially continuous extensible structure 121, for instance, a non-woven sheet. Such a non-woven sheet may be generated from compacted, substantially non-aligned, and intermingled nanotubes 113, bundles of nanotubes, or intertwined nanotubes (e.g., ropes of nanotubes), with sufficient structural integrity to be handled as a sheet.

To collect the fabricated nanotubes 113, belt 120 may be positioned adjacent the exit end 114 of the synthesis chamber 11 to permit the nanotubes to be deposited on to belt 120. In one embodiment, belt 120 may be positioned substantially parallel to the flow of gas from the exit end 114, as illustrated in FIG. 1A. Alternatively, belt 120 may be positioned substantially perpendicular to the flow of gas from the exit end 114 and may be porous in nature to allow the flow of gas carrying the nanomaterials to pass therethrough. Belt 120 may be designed as a continuous loop, similar to a conventional conveyor belt. To that end, belt 120, in an embodiment, may be looped about opposing rotating elements 122 (e.g., rollers) and may be driven by a mechanical device, such as an electric motor. Alternatively, belt 120 may be a rigid cylinder. In one embodiment, the motor may be controlled through the use of a control system, such as a computer or microprocessor, so that tension and velocity can be optimized.

In an alternate embodiment, instead of a non-woven sheet, the fabricated single-walled nanotubes 113 may be collected from synthesis chamber 11, and a yarn 131 may thereafter be formed. Specifically, as the nanotubes 113 emerge from the synthesis chamber 11, they may be collected into a bundle 132, fed into intake end 133 of a spindle 134, and subsequently spun or twisted into yarn 131 therewithin. It should be noted that a continual twist to the yarn 131 can build up sufficient angular stress to cause rotation near a point where new nanotubes 113 arrive at the spindle 134 to further the yarn formation process. Moreover, a continual tension may be applied to the yarn 131 or its advancement into collection chamber 13 may be permitted at a controlled rate, so as to allow its uptake circumferentially about a spool 135.

Typically, the formation of the yarn 131 results from a bundling of nanotubes 113 that may subsequently be tightly spun into a twisting yarn. Alternatively, a main twist of the yarn 131 may be anchored at some point within system 10 and the collected nanotubes 113 may be wound on to the twisting yarn 131. Both of these growth modes can be implemented in connection with the present invention.

Conductive Adapter

Figure 2:
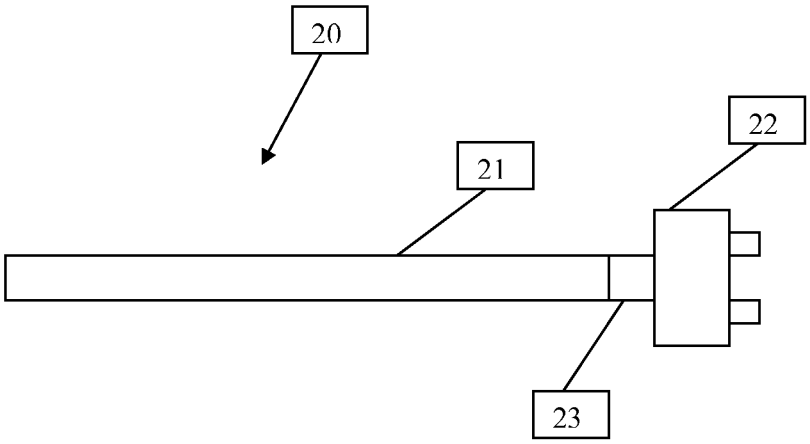
FIG. 2 illustrates an electrically and thermally conductive adapter in accordance with one embodiment of the present invention.

To carry relatively high current pulses between two movable conductors, such as a high energy capacitor, a ground strap, a bus bar or bus pipe, or pulse generating circuit, to an external circuit without degradation of the waveform or without heating of a junction, the present invention provides, in an embodiment, a conductive adapter 20, such as that shown in FIG. 2. The conductive adapter 20 can include, among other things, a conductive nanostructure-based material 21, a connector portion 22, and a coupling mechanism 23 made from a material capable of providing substantially low resistance coupling, while substantially maximizing the number of conductive nanostructures that can be actively involved in conductivity.

In accordance with one embodiment, the adapter 20 includes a conducting member 21 made from a conductive nanostructure-based material. The conductive nanostructure-based material, in an embodiment, may be yarns, ribbons, wires, cables, tapes or sheets (e.g., woven or non-woven sheets) made from carbon nanotubes fabricated in a manner similar to that disclosed above in U.S. patent application Ser. No. 11/488,387. In an embodiment, conducting member 21 may be made from one of carbon, copper, silver, boron-nitride, boron, $MoS_2$, or a combination thereof. Moreover, the material from which the conducting member 21 may be made can include, in an embodiment, graphite of any type, for example, such as that from pyrograph fibers.

The adapter 20 can also include a connector portion 22 to which the conducting member 21 may be joined. In one embodiment, the connector portion 22 may be made from a metallic material, such as copper, aluminum, gold, silver, silver coated copper, cadmium, nickel, tin, bismuth, arsenic, alloys of these metals, boron, boron nitride, a combination thereof, or other materials capable of being electrically and/or thermally conductive. The connector portion 22 may also be made from non-metallic material, such as those having glassy carbons, ceramics, silicon, silicon compounds, gallium arsenide or similar materials, or a combination thereof, so long as the material can be electrically and/or thermally conductive. The connector portion 22, in and embodiment, when coupled to conducting member 21, permits relatively high current from a source that may be carried by the conducting member 21 to be directed to an external circuit without substantial degradation.

To do so, the adapter 20 may further include a coupling mechanism 23 situated between the conducting member 21 and the connector portion 22, so as to join the conducting member 21 to the connector portion 22. In one embodiment, the coupling mechanism 23 may be made from a glassy carbon material capable of providing substantially low resistance coupling. Glassy carbon, in general, may be a form of carbon related to carbon nanotubes and can contain a significant amount of graphene like ribbons comprising a matrix of amorphous carbon. These ribbons include $sp^2$ bonded ribbons that can be substantially similar to the $sp^2$ bonded nanotubes. As a result, they can have relatively good thermal and electrical conductivity. Examples of precursor materials from which glassy carbon can be made include furfuryl alcohol, RESOL resin (i.e., catalyzed alkyl-phenyl formaldehyde), PVA, or liquid resin or any material known to form glassy carbon when heat treated. Of course, other commercially available glassy carbon materials or precursor materials can be used.

In addition, coupling mechanism 23 may also provide the conducting member 21 with substantially uniform contact to the connector portion 22 across a contact surface area on the connector portion 22. To that end, the coupling mechanism 23 can act to substantially maximize the number of conductive nanostructures within the conducting member 21 that can be actively involved in conductivity to enhance efficiency of electrical and thermal transport. For instance, relatively high current from a source and carried by the conducting member 21 can be directed to an external circuit without substantial degradation. The adapter 20 of the present invention, thus, can be used to enable efficient conduction to a standard connector for use in a traditional electrical and/or thermal circuit systems. In particular, adapter 20 can enable efficient interaction, for instance, through electrical and/or thermal conduction, between a nanoscale environment and the traditional electrical and/or thermal circuit system.

For comparison purposes, the electrical and thermal conduction properties for glassy carbon is compared to those properties exhibited by graphite. As illustrated in Table 1 below, the presence of the graphene ribbons can enhance the electrical and therefore the thermal conductivity of glassy carbon relative to that observed with graphite.

TABLE I

| Parameter | Graphite | Glassy Carbon |
|---|---|---|
| Electrical resistivity | $14.70 \times 10^{-4}$ ohm-cm | $0.50 \times 10^{-4}$ ohm-cm |
| Thermal conductivity | 95 w/m ° K | 6.3 w/m ° K |

In another embodiment, there is provided a method for making a conductive adapter of the present invention. The method includes initially providing a conducting member, similar to conducting member 21, made from a nanostructure-based material, and a connector portion, similar to connector portion 22, to which the conducting member may be joined. The nanostructure-based material, in one embodiment, can be those made from conductive carbon nanotube, for instance, yarns, tapes, cables, ribbons, or sheets made from carbon nanotubes. The connector portion, on the other hand, may be made from a metallic material, such as copper, nickel, aluminum, silver, gold, cadmium, tin, bismuth, arsenic, alloys of these metals, boron, boron-nitride, other conductive metals, any conductive metals coated with gold or silver, or a combination thereof. The connector portion may also be made from non-metallic material, such as those having glassy carbon forms, ceramics, silicon, silicon compounds, gallium arsenide, or similar materials, so long as the material can be electrically and/or thermally conductive.

Next, a coupling mechanism, similar to coupling mechanism 23, may be placed at a junction between the conducting member and the connector portion. In an embodiment, the coupling mechanism may be a glassy carbon precursor, such as furfuryl alcohol, Resol resin, PVA or any material known to form glassy carbon when heat treated that can be deposited into the junction. It should be appreciated that the tendency of the glassy carbon resin or material to "wet" the nanotubes in the conducting member can help to coat each individual nanotube, so that each nanotube can contribute to electron or thermal transport.

The conducting member and connector portion may thereafter be held against one another, while the junction between the conducting member and the connector portion may be heated to a temperature range sufficient to pyrolyze the glassy carbon precursor to form a glassy carbon low resistance coupling mechanism. In one embodiment, the minimum temperature of pyrolysis should be at least in the neighborhood of about 400° C. to about 450° C. If pyrolysis is carried out in an inert atmosphere, the temperature may need to be higher to permit the pyrolysis process to go to completion.

It should be appreciated that materials that may be sensitive to this temperature may not be suitable for this invention. Moreover, pyrolysis need not go to completion for this junction to offer substantially superior contact resistance to the traditional means for coupling conducting members.

Figure 3:
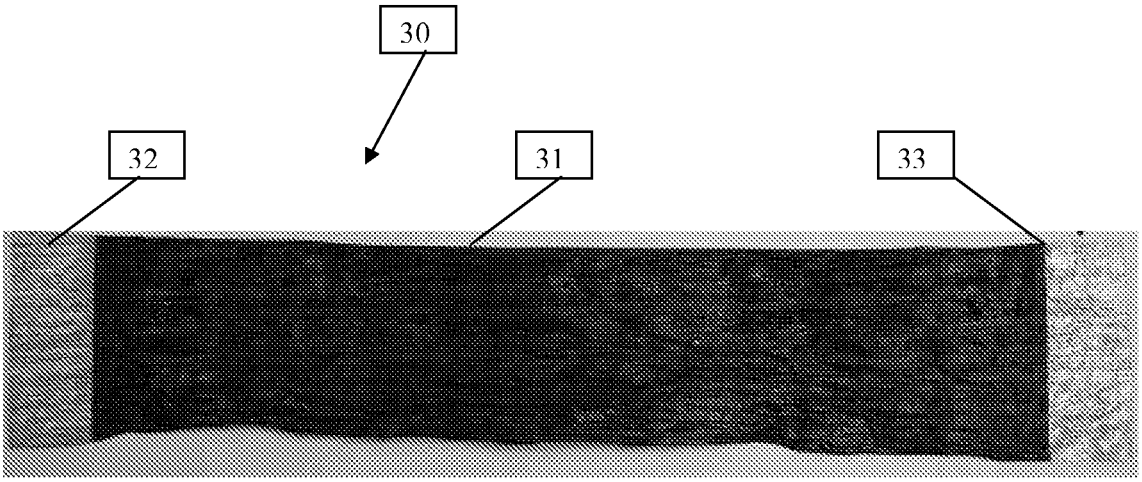
FIG. 3 illustrates an electrically and thermally conductive adapter in accordance with another embodiment of the present invention

Looking now at FIG. 3, in accordance with another embodiment of the present invention, there is shown a conductive adapter 30, for carrying relatively high current from a source to an external circuit without substantial degradation of the waveform or without substantially heating of a junction.

In the embodiment shown in FIG. 3, adapter 30 includes a conducting member 31 made from a conductive nanostructure-based material. The conductive nanostructure-based material, in an embodiment, may include yarns, ribbons, cables, tapes or sheets (e.g., woven or non-woven sheets) made from carbon nanotubes fabricated in a manner similar to that disclosed above in U.S. patent application Ser. No. 11/488,387. In an embodiment, conducting member 31 may be made from one of carbon, copper, silver, boron-nitride, boron, $MoS_2$, or a combination thereof. The material from which the conducting member 31 may be made can also include, in an embodiment, graphite of any type, for example, such as that from pyrograph fibers.

Adapter 30, as illustrated, can also include a connector portion 32 at each of opposing ends of the conducting member 31. In one embodiment of the invention, connector portion 32 may be a coating deposited, such as electroplating, directly on each end of conducting member 31. Deposition or electroplating of connector portion 32 on to conducting member 31 can be carried out using methods well known in the art. Examples of electroplated connector portion 32 include gold, silver, nickel, aluminum, copper, bismuth, tin, zinc, cadmium, tin-nickel alloy, copper alloy, tin-zinc alloy, bismuth-copper alloy, cadmium-nickel alloy, other conductive metals and their alloys, or a combination thereof.

Connector portion 32, in an embodiment, may be deposited or electroplated on to conducting member 31 substantially uniformly, so as to permit substantially uniform contact of the nanotubes in conducting member 31 across a contact surface area on the connector portion 32. As such, the connector portion 32 can act to substantially maximize the number of conductive nanostructures within the conducting member 31 that can be actively involved in conductivity to enhance efficiency of electrical and thermal transport and reduce contact resistance. To that end, relatively high current from a source and carried by the conducting member 31 can be directed to an external circuit without substantial degradation. The adapter 30, thus, can be used to enable efficient interaction, for instance, through electrical and/or thermal conduction, between a nanoscale environment and the traditional electrical and/or thermal circuit system, as well as conduction to a standard connector for use in a traditional electrical and/or thermal circuit systems.

With reference now to FIGS. 4A-B, in accordance with a further embodiment of the present invention, an adapter 40 can be designed to extend or expand in at least one direction, for instance, lengthwise, without compromising or substantially changing the resistivity of the adapter 40. In other words, resistivity or the resistance property of the adapter 40 can be independent of extension or expansion of adapter 40, even if the extension or expansion is to a substantially extreme degree.

Adapter 40, in one embodiment, includes a conducting member 41 made from a conductive nanostructure-based material. Such a material may be a sheet (e.g., woven or non-woven sheet) a plurality of tapes or ribbons made from carbon nanotubes, similar in manner to that disclosed in U.S. patent application Ser. No. 11/488,387. Moreover, the material from which the conducting member is made may include, in an embodiment, graphite of any type, for example, such as that from pyrograph fibers.

However, unlike adapter 30 shown in FIG. 3, conducting member 41 of adapter 40 may be imparted or etched with various patterns, including that shown in FIGS. 4A and 4B to permit the adapter 40 to extend or expand, for instance, in a lengthwise direction (i.e., along the X axis) when pulled axially from opposite ends of the adapter 40 (see FIG. 4B). It should be appreciated that in addition to the patterns shown in FIGS. 4A and 4B, the conducting member 41 may include other patterns or designs, so long as such a pattern or design permits extension of adapter 40.

Although shown extending in a lengthwise direction, adapter 40 may also be designed to extend along its width (i.e., along the Y axis). As shown in FIGS. 4C-D, conducting member 41 may be provided with any pattern known in the art that allows the adapter 40 to extend or be extensible along its width. It should be appreciated that conducting member 41 may also include a pattern that allows the adapter 40 to extend lengthwise as well as along its width (i.e., in two dimensions).

Figure 4E:
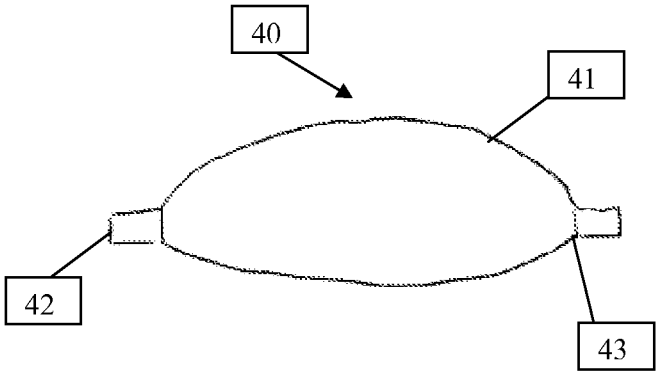

To the extent desired, looking now at FIG. 4E, adapter 40 may include two or more layers of conducting member 41, one on top of the other, and substantially non-bonded to one another, along their length, so that adapter 40 may also be extendible along the Z axis. In such an embodiment, conducting members 41 may be bonded to one another along their respective edges 43. In an embodiment bonding of the edges 43 can be accomplished by the use of a glassy carbon material, such as that provided above.

In addition to being extendible, conducting member 41 may also be provided with shape memory capability. Specifically, the nanotubes from which conducting member 41 may be made can permit the conducting member 41 to retract substantially back to its originally length, width or shape (see FIG. 4A) after the conducting member 41 has been extended (see FIG. 4B) along one, two or three dimensions.

The pattern, design or etching provided on conducting member 41, in an embodiment, may be implement by processes known in the art, include stamping, laser etching etc.

The adapter 40 can also include a connector portion 42 at each of opposing ends of the conducting member 41. In one embodiment of the invention, connector portion 42 may be a coating deposited, such as by electroplating, directly on each end of conducting member 41. Deposition or electroplating of connector portion 42 on to conducting member 41 can be carried out using methods well known in the art. In one embodiment, the connector portion 42 may be made from a metallic material, such as gold, silver, nickel, aluminum, copper, bismuth, tin, zinc, cadmium, tin-nickel alloy, copper alloy, tin-zinc alloy, bismuth-copper alloy, cadmium-nickel alloy, other conductive metals and their alloys, or a combination thereof. The connector portion 42 may also be made from non-metallic material, such as those having glassy carbon forms, or similar materials, so long as the material can be electrically and/or thermally conductive. To the extent that the adapter 40 may be designed to allow conducting member 41 to extend or be extensible along its width, similar to that shown in FIG. 4D, connector portion 42 may also be designed to extend or be extensible widthwise along with the conducting member 41.

In accordance with one embodiment, connector portion 42 may be deposited or electroplated on to conducting member 41 substantially uniformly to permit substantially uniform contact of the nanotubes in conducting member 41 across a contact surface area on the connector portion 42. To that end, the connector portion 42 can act to substantially maximize the number of conductive nanostructures within the conducting member 41 that can be actively involved in conductivity to enhance efficiency of electrical and thermal transport. The adapter 40 of the present invention can be used to enable efficient interaction, for instance, through electrical and/or thermal conduction, between a nanoscale environment and the traditional electrical and/or thermal circuit system, as well as conduction to a standard connector for use in a traditional electrical and/or thermal circuit systems.

Adapters 20, 30 and 40 may be used as current conducting members, including high current conducting members, capacitors, battery electrodes, fuel cell electrodes, as well as for thermal transport, for high frequency transport, and many other applications. With respect to adapter 40, because of its ability to extend, its shape memory capability, as well as its thermal and electrical conductive properties, adapter 40 may be used for a variety of structural and mechanical applications, including those in connection with the aerospace industry, for example, as a conducting member on modern airplane wings that have curved up designs.

EXAMPLE I

Wires for use as current conducting members can be made from yarns that have been fabricated using carbon nanotubes of the present invention. In one embodiment, a plurality of carbon nanotube yarns was coated with a glassy carbon resin and bonded together to form a wire. The wire was then heated to about 125° C. for about one hour. Following this heating step, the wire was transferred to a high temperature furnace where it was heated to a temperature at least 450° C. for about another hour in an inert atmosphere.

Wires made from carbon nanotube yarns were observed to have a resistivity in the semiconducting member state of about $0.5\times10^{-5}$ to about $4\times10^{-4}$.

The thermal conductivity of the wires made from carbon nanotube yarns was also measured. In an example, the thermal conductivity of wires made from carbon nanotube yarns were observed to be between about 5 Watts/meter-degree K and about 70 Watts/meter-degree K. This wide variation in thermal conductivity may be a result of the wide variation in tube diameters and tube lengths, all of which contribute to variation of these parameters.

It should be appreciated that the tendency of the glassy carbon resin to "wet" the nanotube material can help to coat each individual tube, so that each tube can contribute to the electron or thermal transport. In addition, the coefficient of thermal expansion of the carbon nanotube yarns and the glassy carbon resin should result in fewer strains at the interface between adjacent yarns.

Since wires made from carbon nanotube yarns are relatively better as electrical and thermal conductors, these yarns, in an embodiment, can be made into insulated multi-stranded cables by usual commercial processes. The resulting cables can then be coupled to commonly used end connectors (i.e., connector portions) to enable efficient interaction between a nanoscale environment and the traditional electrical and/or thermal circuit system.

EXAMPLE II

In the same way as the wires above, carbon nanotube tapes or ribbons can be made from strips of carbon nanotube textiles. In one embodiment, a plurality of the strips were joined together by coating a surface of each strip with furfuryl alcohol (i.e., glassy carbon precursor), then mechanically compressing the joint between adjacent strips. The amount of glassy carbon precursor added to the strips depends on the thickness of the strips. For optimal conduction, the joints should be saturated. While compressing, the joined strips (i.e., tape or ribbon) was heated to about 125° C. for about one hour. Following this heating step, the tape or ribbon was transferred to a high temperature furnace where it was heated to a temperature at least 450° C. for about another hour in an inert atmosphere.

The resulting tape or ribbon can serve as (i) high current conducting members for high frequency transport of, for instance, very high frequency signals, as well as (ii) very efficient heat conducting members for thermal transport.

In addition, since based on weight, the tapes of the present invention can conduct substantially better than copper or aluminum, the resulting tapes or ribbons can be coupled to commonly used end connector portions to enable efficient interaction between a nanoscale environment and the traditional electrical and/or thermal circuit system.

It should be noted that even at relatively low frequencies, the junctions in the tapes or ribbons can be conductive at frequencies substantially above 50 MHz, and that the joint may heat up. Nevertheless, the junctions should be able to tolerate temperatures of up to about 400° C. in air, and much higher in an inert atmosphere, for a short period without degrading.

EXAMPLE III

Joining of the above wires, tapes, yarns, ribbons or multiple ribbon conducting members to standard connectors (i.e., connector portions) can be also be carried out in accordance with the following method of the present invention.

In one embodiment, the insides of contact surfaces of a connector portion can be coated with, for example, malic acid (1%) catalyzed furfuryl alcohol. Then, the wire, yarn, tape or ribbon conducting member was inserted into the connector portion. The connector portion was then heated to about 125° C. for about one hour. Thereafter, the temperature was increase to about 450° C. for at least on hour in an inert gas environment.

The resulting wire, yarn, tape or ribbon conducting member having a commonly used end connector portion can be utilized to enable efficient interaction between a nanoscale environment and the traditional electrical and/or thermal circuit system.

EXAMPLE IV

The tapes, ribbons or wires generated in the above examples can be bonded to a heat collector or to a current collector for use in the collection of heat or harvesting of current. In particular, the tapes, ribbons or wires (i.e., conducting members) can be initially be coated with a glassy carbon resin. Then, the coated conducting member can be coupled to a copper or silver coated copper connector portion. Thereafter, the glassy carbon precursor in the juncture between each conducting member and each connector portion may be pyrolyzed to bond each connector portion to each conducting member. The pyrolysis process can be carried out at a temperature of about 400° C. or more.

In addition, pyrolysis can be done in a helium, argon, or nitrogen environment, or in a vacuum. The duration of the pyrolysis depends on the amount of the precursor material in the juncture. Since the glassy carbon resin cures by releasing mostly water, it may be desirable to provide an exit path for the reaction products of the pyrolysis process. If this not done, then the duration of the pyrolysis may have to be extended.

Once completed the resulting adaptive conducting members can be bonded to a copper heat collector or to a copper silver current collector for use in the collection of heat or harvesting of current.

EXAMPLE V

A conducting member sheet made from nanotubes of the present invention can be bonded to a connector portion to be utilized as capacitor electrode. For use as a connector portion, samples of aluminum (or titanium) foil of thickness ranging from about 5 microns to about 50 microns, and preferable about 25 microns were cleaned with acetone, hexane and methanol. The samples were then coated with furfuryl alcohol catalyzed with 1% malic acid. The coating was applied by any means necessary to provide a very thin (about 0.01 microns to about 10 microns, and preferably about 0.5 microns).

Next, on to the coated foil was placed a carbon nanotube sheet having a density of about 0.5 mg/cm$^2$. This sheet bonded weakly to the foil by the surface tension of the alcohol. The coated foil was then allowed to air dry, then transferred to an oven set at about 100° C. to polymerize for one or more hours. Following this polymerization process, the coated foil was transferred to an oven and heated slowly, about 20° C. per minute or less, up to at least 400° C., and held at this temperature for at least one hour. It could then be cooled at any rate to ambient and used as a super capacitor electrode.

It should be appreciated that these examples are extremely conservative. It is likely that it may be possible to heat these connects with a fast technique, such as microwave, so that the polymerization and the transformation step can happen in one production process and at very high speeds. The thinner the coating of the glassy carbon and the shorter the diffusion distance of the mainly water reaction product to the environment the fast the heating process.

EXAMPLE VI

Sheets of carbon nanotubes made from the present invention can have a wide variety of applications. Many of these applications include having the sheets bonded to a substrate (i.e., connector portion) using a glassy carbon material. Examples of specific applications include battery electrodes or fuel cell electrodes, in addition to the above capacitor electrodes. The substrates employed may be foils of copper, titanium, stainless steels, or even non-metal polymers or ceramics. For these and similar applications, it can be important that the glassy carbon precursor be provided in a substantially thin layer, so that infiltration into the carbon nanotube sheet can be minimized to prevent degradation to the properties of the sheet.

A straight forward means of accomplishing this can be to roll a very precise layer of the glassy carbon precursor on to the foil or substrate connector portion, then to place the carbon nanotube sheet onto this substrate connector portion. Thereafter the resulting assembly can be cured first at relatively low temperatures of about 100° C. in order to polymerize the glassy carbon resin. Subsequently, a high temperature heat treatment can be employed at temperatures in excess of 400° C. for a period of time sufficient to convert most of the resin to a glassy carbon material. Other means known in the art may also be suitable, such as electrostatic spraying, web coating, or brushing on the material.

EXAMPLE VII

The bonding of a carbon nanotube sheets onto a substrate connector portion can have additional applications, such as utilizing the resulting assembly in the absorption of radar signal (EMI shielding) or to provide other desirable properties, such as lighting protection. For such applications, it may not be critical if the bonding agent penetrates the carbon nanotube sheet. Accordingly, the glassy carbon material can be coated with less care than for that carried out in capacitor, battery or fuel cell applications. In one embodiment, the substrate for applications in this example can be a graphite epoxy, e-glass epoxy, or combinations with other types of matrices.

While the present invention has been described with reference to certain embodiments thereof, it should be understood by those skilled in the art that various changes may be made and equivalents may be substituted without departing from the true spirit and scope of the invention. In addition, many modifications may be made to adapt to a particular situation, indication, material and composition of matter, process step or steps, without departing from the spirit and scope of the present invention. All such modifications are intended to be within the scope of the claims appended hereto.

What is claimed is:

1. A conductive adapter comprising:

a conducting member made from a plurality of intermingled and non-aligned nanotubes arranged on top of one another to form a continuous structure and being able to support itself structurally, independent of the assistance of a substrate or binder, and having opposing ends;

a flexible body defined by the conducting member and able to directly withstand fatigue damage caused by movement that can result in such fatigue damage when imparted on the flexible body; and a flexible glassy carbon connector portion positioned on one of the opposing ends of the conducting member in such a way as to be in direct contact with the conducting member to maximize a number of conductive nanostructures within the conducting member in contact with the connector portion, so as to enable efficient conduction between a nanoscale environment and a traditional electrical and/or thermal circuit system.

2. An adapter as set forth in claim 1, wherein the conducting member includes one of wires, yarns, tapes, ribbons, or sheets made from nanotubes.

3. An adapter as set forth in claim 2, wherein the nanotubes are made from one of carbon, copper, silver, boron, boron-nitride, $MoS_2$ or similar compounds, or a combination thereof.

4. An adapter as set forth in claim 1, wherein the conducting member includes a graphite material.

5. An adapter as set forth in claim 1, wherein the connector portion further includes one of copper, aluminum, gold, silver, silver coated copper, cadmium, nickel, tin, bismuth, arsenic, alloys of these metals, boron, boron nitride, ceramics, silicon, silicon compounds, gallium arsenide, a combination thereof, or other materials capable of being electrically and/or thermally conductive.

6. An adapter as set forth in claim 1, wherein the connector portion enables relatively high current from a source and carried by the conducting member to be directed to an external circuit without substantial degradation.

7. An adapter as set forth in claim 1, wherein the connector portion is deposited on at least one of the opposing ends of the conducting member.

8. An adapter as set forth in claim 7, wherein the connector portion is electroplated on each of the opposing ends of the conducting member.

9. An adapter as set forth in claim 7, wherein the deposited connector portion further includes one of gold, silver, nickel, aluminum, copper, bismuth, tin, zinc, cadmium, tin-nickel alloy, copper alloy, tin-zinc alloy, bismuth-copper alloy, cadmium-nickel alloy, other conductive metals and their alloys, or a combination thereof.

10. An adapter as set forth in claim 7, wherein the conducting member includes a pattern to permit extension of the conducting member in at least one direction.

11. An adapter as set forth in claim 10, wherein the pattern permits extension of the conducting member along one of an X axis, Y axis, or a combination thereof.

12. An adapter as set forth in claim 10, wherein the conducting member, when extended, does not compromise or substantially change the resistivity of the adapter.

13. An adapter as set forth in claim 1, wherein the glassy carbon material is generated from a precursor material including one of furfuryl alcohol, RESOL resin, PVA, or other liquid resin or materials capable of forming a glassy carbon material.

14. An adapter as set forth in claim 1, wherein the glassy carbon material is capable of enhancing electrical or thermal conductivity between the conducting member and the connector portion.

15. An adapter as set forth in claim 1 designed to use in one of thermal conduction, electrical conduction, EMI applications, high current transmission, RF applications, pulsed applications, thermo-electric and/or power generation, sensor applications, or other similar applications.

16. An adapter as set forth in claim 1 designed to enable efficient conduction to a standard connector for use in a traditional electrical and/or thermal circuit systems.

17. An adapter as set forth in claim 1, a junction between the conducting member and the connector portion is able to tolerate temperature of up to about 400° C. or higher without degrading.

18. An adapter as set forth in claim 1, wherein the conducting member is plated with one of gold, silver, nickel, aluminum, copper, bismuth, tin, zinc, cadmium, tin-nickel alloy, copper alloy, tin-zinc alloy, bismuth-copper alloy, cadmium-nickel alloy, other conductive metals and their alloys, or a combination thereof.

19. A conductive adapter comprising:

a conducting member made from a plurality of intermingled and non-aligned nanotubes arranged on top of one another to form a continuous structure with sufficient structural integrity to be handled and having opposing ends;

a flexible body defined by the conductive member and able to directly withstand fatigue damage caused by movement that can result in such fatigue damage when imparted on the flexible body;

a flexible connector portion positioned on one of the opposing ends of the conducting member in such a way as to maximize a number of conductive nanostructures within the conducting member in contact with the connector portion, so as to enable efficient conduction between a nanoscale environment and a traditional electrical and/or thermal circuit system; and a flexible glassy carbon coupling mechanism situated between the conducting member and the connector portion to provide a substantially uniform contact between the conductive nanostructure-based material in the conducting member and the connector portion, the coupling mechanism conforming to movement of the flexible body and the flexible connector portion and being generated from a precursor material including one of furfuryl alcohol, RESOL resin, PVA, or other liquid resin or materials capable of forming a glassy carbon material.

20. An adapter as set forth in claim 19, wherein the conducting member includes one of wires, yarns, tapes, ribbons, or sheets made from nanotubes.

21. An adapter as set forth in claim 20, wherein the nanotubes are made from one of carbon, copper, silver, boron, boron-nitride, $MoS_2$ or similar compounds, or a combination thereof.

22. An adapter as set forth in claim 19, wherein the conducting member includes graphite or another form of carbon.

23. An adapter as set forth in claim 19, wherein the connector portion further includes one of copper, aluminum, gold, silver, silver coated copper, cadmium, nickel, tin, bismuth, arsenic, alloys of these metals, boron, boron nitride, ceramics, silicon, silicon compounds, gallium arsenide, a combination thereof, or other materials capable of being electrically and/or thermally conductive.

24. An adapter as set forth in claim 19, wherein the connector portion enables relatively high current from a source and carried by the conducting member to be directed to an external circuit without substantial degradation.

25. An adapter as set forth in claim 19, wherein the connector portion is deposited on at least one of the opposing ends of the conducting member.

26. An adapter as set forth in claim 25, wherein the connector portion is electroplated on each of the opposing ends of the conducting member.

27. An adapter as set forth in claim 25, wherein the deposited connector portion further includes one of gold, silver, nickel, aluminum, copper, bismuth, tin, zinc, cadmium, tin-nickel alloy, copper alloy, tin-zinc alloy, bismuth-copper alloy, cadmium-nickel alloy, other conductive metals and their alloys, or a combination thereof.

28. An adapter as set forth in claim 25, wherein the conducting member includes a pattern to permit extension of the conducting member in at least one direction.

29. An adapter as set forth in claim 28, wherein the pattern permits extension of the conducting member along one of an X axis, Y axis, or a combination thereof.

30. An adapter as set forth in claim 28, wherein the conducting member, when extended, does not compromise or substantially change the resistivity of the adapter.

31. An adapter as set forth in claim 19, wherein the coupling mechanism provides substantially low resistance coupling of the conducting member to the connector portion.

32. An adapter as set forth in claim 19, wherein the glassy carbon material is capable of enhancing electrical or thermal conductivity between the conducting member and the connector portion.

33. An adapter as set forth in claim 19 designed to use in one of thermal conduction, electrical conduction, EMI applications, high current transmission, RF applications, pulsed applications, thermo-electric and/or power generation, sensor applications, or other similar applications.

34. An adapter as set forth in claim 19 designed to enable efficient conduction to a standard connector for use in a traditional electrical and/or thermal circuit systems.

35. An adapter as set forth in claim 19, a junction between the conducting member and the connector portion is able to tolerate temperature of up to about 400° C. or higher without degrading.

36. An adapter as set forth in claim 19, wherein the conducting member is plated with one of gold, silver, nickel, aluminum, copper, bismuth, tin, zinc, cadmium, tin-nickel alloy, copper alloy, tin-zinc alloy, bismuth-copper alloy, cadmium-nickel alloy, other conductive metals and their alloys, or a combination thereof.

* * * * *